United States Patent [19]

Ikehata et al.

[11] Patent Number: 4,565,664

[45] Date of Patent: Jan. 21, 1986

[54] DRAWN TUBING MANUFACTURING PROCESS AND APPARATUS THEREFOR

[75] Inventors: Shigeki Ikehata; Kuniharu Shutoh; Kazuya Aoyagi, all of Amagasaki, Japan

[73] Assignee: Sumitomo Metal Industries, Ltd., Osaka, Japan

[21] Appl. No.: 476,274

[22] Filed: Mar. 17, 1983

[30] Foreign Application Priority Data

Mar. 18, 1982 [JP] Japan ..... 57-41744

[51] Int. Cl.[4] ..... B29D 23/04

[52] U.S. Cl. ..... 264/130; 72/41; 72/348; 72/349; 72/370; 264/209.2; 264/209.5; 264/292; 264/294; 264/320; 264/323; 425/96; 425/106; 425/393; 425/418

[58] Field of Search ..... 264/209.1, 323, 310, 264/312, 209.2, 209.3, 209.4, 209.5, 130, 320, 294, 292; 72/348, 349, 41, 370; 425/418, 107, 96

[56] References Cited

U.S. PATENT DOCUMENTS 1,913,206 6/1933 Littler ..... 72/349
3,036,696 5/1962 Zimpel ..... 72/348
4,225,547 9/1980 Okita ..... 264/209.2
4,262,516 4/1981 Weber et al. ..... 72/348

*Primary Examiner*—Jeffery Thurlow
*Attorney, Agent, or Firm*—Burns, Doane, Swecker & Mathis

[57] ABSTRACT

Herein disclosed is a process of manufacturing drawn tubing, in which steps of applying a lubricant to the surface of a bottomed blank fitted on a mandrel, pushing out the mandrel to draw the blank through a die, and pulling in the drawn blank together with the mandrel out of the die are repeated in the recited order. The drawn blank is turned a predetermined angle, e.g., 180 degrees on the axis thereof during each of the repeating steps i.e., during or after the pulling step. As a result, the lubricant can be applied to another portion of the blank surface at a second or subsequent applying step so that the working conditions which might otherwise become different to cause the drawn blank to have a locally irregular or offset thickness can be made uniform in the circumferential direction of the blank. Also disclosed for practicing the process is a drawn tubing manufacturing press of horizontal type, in which turning means is provided for turning the mandrel the predetermined angle on the axis thereof relative to the mandrel holder thereby to turn the drawn blank the same angle.

15 Claims, 12 Drawing Figures

FIG.4(B)
FIG.4(A)
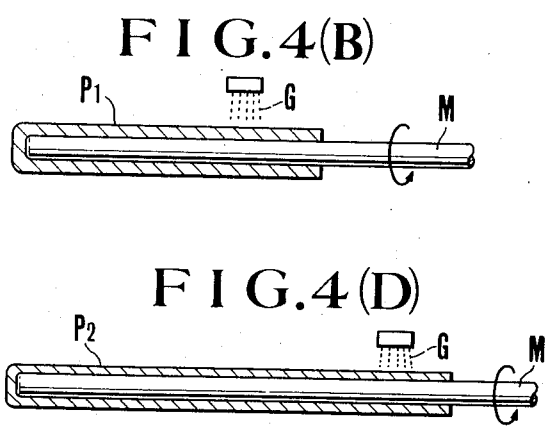
FIG.4(D)
FIG.4(C)
FIG.4(E)
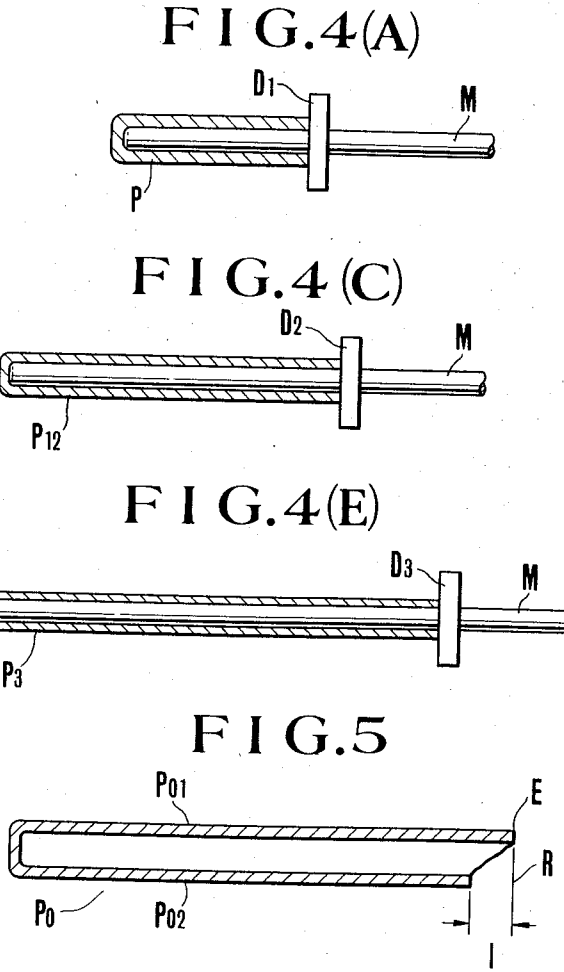
FIG.5
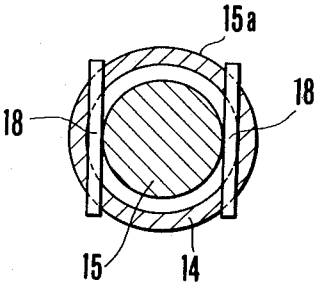
FIG.7

DRAWN TUBING MANUFACTURING PROCESS AND APPARATUS THEREFOR

BACKGROUND OF THE INVENTION

The present invention relates to a process of manufacturing drawn tubing by turning a mandrel on its axis as well as to a drawn tubing manufacturing press of horizontal type.

Heretofore, there has been practised the so-called "push bench process" or a drawn tubing manufacturing process in which such a bottomed blank of the metal to be drawn as has been pierced in advance by the so-called "Ehrhardt piercing process" or a press piercing process is fitted on the mandrel of a horizontal press so that it may be drawn through a die having an orifice of the desired shape. The push bench process is accepted as one of the most important processes of manufacturing a seamless pipe because it is excellent for producing thick-walled tubing having a relatively large diameter.

For the drawing step, moreover, the horizontal press is used, the mandrel of which is secured to a cross head at all times during the production except when it is replaced by another for changing the pipe size, no matter whether the so-called "tandem die process" or "single die process" might be resorted to.

Here, in the push bench process of the above-specified kind, occurrence of irregularities in the thickness of the drawn product should be obviated as much as possible because the cutting allowance, which is taken into consideration when the drawing is to be finished is increased to not only elongate the tme period for the cutting step but also reduce the yield. Moreover, three major causes for inviting that irregular thickness have been found out along with auxiliary causes such as irregular size or burn of the formed blank. First of the major causes comes from the fact that application of a lubricant is limited to a portion of the surface of the blank, because the press is of the horizontal type so that the lubricant or glass powder is scattered only onto the upper surface of the blank. A second major cause is formed by the fact that a die may frequently be inclined with respect to the axis of the mandrel. A third major cause occurs as a result that the mandrel may be bent during or after the drawing step.

By those three major causes and the auxiliary causes thus far described, the thickness of the drawn tubular product becomes longitudinally and circumferentially irregular. Noting that the occurrence of the thickness irregularities is strongly dependent upon that the working conditions are different in the circumferential direction, we, the Inventors, have succeeded in discovering the fact that the drawn tubing having a uniform thickness can be finally produced if the working conditions are satisfied to automatically correct the thickness irregularities which have been caused at a preceding drawing step. Specifically, since a plurality of drawing steps are incorporated in the usual push bench process, the satisfaction of those working conditions can be attained if a subsequent drawing step is conducted after the mandrel has been turned a predetermined abgle, e.g., 180 degrees at an interval during two consecutive drawing steps.

SUMMARY OF THE INVENTION

It is, therefore, an object of the present invention to provide a process of manufacturing drawn tubing, which can automatically eliminate longitudinal and circumferential irregularities in the thickness of the drawn tubing.

Another object of the present invention is to provide a drawn tubing manufacturing process in which a drawn blank is turned before a subsequent drawing step so that a lubricant can be applied to the portion of the surface of the drawn blank other than the portion having been lubricated at the preceding drawing step and so that such working conditions as might otherwise become different to cause the irregularities in the thickness of a drawn tubular product can be made uniform in the circumferential direction of the blank to be further drawn.

A further object of the present invention is to provide a drawn tubing manufacturing press of horizontal type for practising the process which is intended to achieve the above-specified objects.

According to one aspect of the present invention, there is provided a process of manufacturing drawn tubing by using a press having a mandrel and a die, comprising: the steps of: preparing a formed blank having a thick-walled cup shape; fitting said formed blank on the mandrel of said press with the bottom of the former abutting against the leading end of the latter; applying a lubricant to a portion of the surface of said blank; pushing out said mandrel by the action of said press to draw said blank through the die of said press; pulling in the drawn blank together with said mandrel out of said die by the action of said press; and repeating the applying, pushing and pulling steps in the recited order until a drawn tubular product having desired shape and size is manufactured, wherein the improvement comprises the step of turning said drawn blank a predetermined angle on the axis thereof through said mandrel during each of said repeating steps, whereby said lubricant can be applied to another portion of the surface of said drawn blank at a second or subsequent applying step so that longitudinal and circumferential irregularities, if any, in the thickness of said tubular product can be automatically eliminated by said turning step after the final repeating step.

According to another aspect of the present invention there is provided a drawn tubing manufacturing press of horizontal type, comprising: a hydraulic cylinder for pushing out and pulling in a ram; a cross head secured to the leading end of said ram and adapted to be actuated by said hydraulic cylinder through said ram for moving back and forth; a mandrel holder fitted in said cross head; a mandrel end member fitted in said mandrel for turning on the axis thereof; a mandrel removably connected to said mandrel end member; and a die for receiving a blank together with said mandrel to draw said blank into desired shape and size when said blank is pushed out through said mandrel, said mandrel end member, said mandrel holder, said cross head and said ram by the actuation of said hydraulic cylinder, wherein the improvement comprises turning means for turning said mandrel a predetermined angle on the axis thereof through said mandrel end member relative to said mandrel holder and said cross head thereby to turn said drawn blank said predetermined angle.

BRIEF DESCRIPTION OF THE DRAWINGS

Other objects, features and advantages of the present invention will become apparent from the following description taken in conjunction with the accompanying drawings, in which:

FIGS. 4(A) to 4(E) are also longitudinal sections illustrating the drawn tubing manufacturing process according to the present invention in the order of the steps inclusive;

FIG. 5 is a longitudinal section showing a drawn blank which is locally elongated;

FIG. 7 is a section taken along line 7—7 of FIG. 6; and

DESCRIPTION OF THE PREFERRED EMBODIMENT

Figure 1:
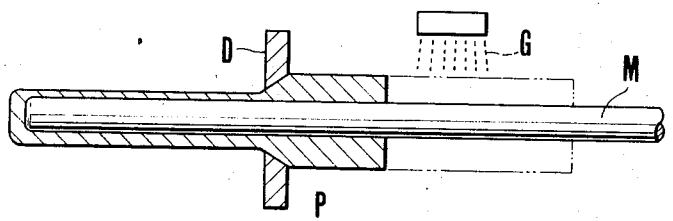
FIG. 1 PRIOR ART
FIGS. 1 to 3 are longitudinal sections schematically showing blank drawing steps according to the prior art so as to explain the three major causes for inviting the irregularities in the thickness of the drawn tubular product.

Before entering into detailed description of the present invention, cursory review will be made upon the prior art with reference to FIGS. 1, 2 and 3 so that the foregoing three major causes for irregularities in the thickness of a drawn tubular product may be more illustratively understood. As shown in FIG. 1, a lubricant G to minimize friction and protect the die surfaces, such as glass powder, is scattered onto the surface of a bottomed blank P of the desired metal or a formed blank having a thick-walled cup shape when this blank P is to be drawn by means of a die D and a mandrel M. During this lubricating step, however, a hydraulically operated ram moves horizontally, and the lubricant G is usually applied only to the upper surface of the blank P so that it fails to spread over the lower surface. As a result, the tubular product has its upper thickness reduced, with close reference to FIG. 1, because the lubricating effect can be obtained only at the upper surface of the blank P.

Figure 2:
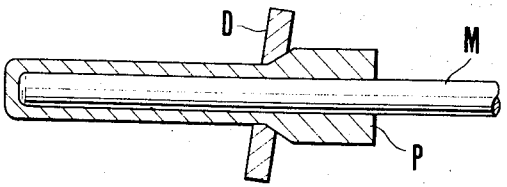
FIG. 2 PRIOR ART

Turning to FIG. 2, the tubular product may be locally thinned if the die D is inclined at an angle of elevation to the coming blank P with respect to the axis of the mandrel M. For this second cause, the tubular product has its thickness reduced at one side, e.g., at its lower side, as shown.

Figure 3:
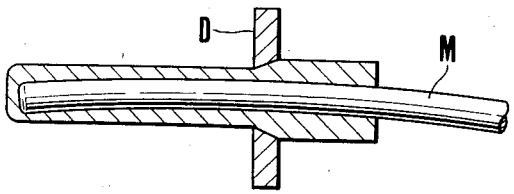
FIG. 3 PRIOR ART

On the other hand, the mandrel M may be curved during or after a protruding step, as shown in FIG. 3. This third cause invites such longitudinal and circumferential irregularities in the thickness of the drawn product as accord with the curvature of the mandrel M.

The present invention will be described in detail in the following with reference to FIGS. 4 to 8 in connection with one preferred embodiment thereof for providing proper working conditions which succeed in automatically correcting the thickness irregularities, if any, of a drawn tubular product.

FIGS. 4(A) to 4(E) illustrate the process of manufacturing tubing by using a mandrel and a die according to the present invention in the order of the steps inclusive. Incidentally, it should be accepted that the process of the present invention can be applied to either the so-called "tandem die process" or "single die process".

First of all, a bottomed blank P of the desired metal or a formed blank having a thick-walled cup shape is prepared by the so-called "Ehrhardt piecing process". This bottomed blank P is fitted on the mandrel M of a horizontal press (although not shown) such that its bottom abuts against the leading end of the mandrel M. In other words, the mandrel M is fitted in the cavity of the bottomed blank P. Incidentally, the mandrel M is prepared to have the desired inside shape of the final product. Then, the mandrel M is pushed out to draw the blank P, as shown in FIG. 4(A), by a hydraulically operated ram (although not shown) through a clearance defined between the inner wall of a first die $D_1$ having an orifice of the desired shape and the outer wall of the mandrel M, thereby to prepare a drawing or a once-drawn blank $P_1$. Although not shown, a suitable lubricant has already been applied to the upper surface of the blank P before the aforementioned first drawing step so as to minimize friction and protect the surfaces of the die $D_1$, as will be easily understood. Next, as shown in FIG. 4(B), the once-drawn blank $P_1$ is pulled in together with the mandrel M out of the die $D_1$ into its retracted position by the action of the ram. At this position, the mandrel M is turned a predetermined angle, e.g., 180 degrees on its axis to turn the first drawn blank $P_1$ upside down. The drawn blank $P_1$ thus turned is then subjected to another lubricating treatment, in which a suitable lubricant G such as glass powder is scattered onto the renewed upper surface of the first blank $P_1$ thus turned back. After that, the die $D_1$ is replaced by another die $D_2$ having a smaller orifice, as shown in FIG. 4(C), to prepare a second drawing step. At this second drawing step, the blank $P_1$ having been lubricated is drawn through the die $D_2$ by pushing out the mandrel M thereby to prepare a second protrusion or protruded blank $P_2$ by way of an intermediate protrusion $P_{12}$ shown in FIG. 4(C). Next, the twice-drawn blank $P_2$ of FIG. 4(D) is pulled in together with the mandrel M out of the die $D_2$ into its retracted position. At this position, the mandrel M is also turned to have its circumferential position changed. The drawn blank $P_2$ thus turned is then subjected to a second lubricating treatment by the use of the lubricant G. After that, the second die $Di_2$ is replaced by a third die $D_3$ having a far smaller orifice, as shown in FIG. 4(E), to conduct a third drawing step for preparing a drawn blank $P_3$.

The lubricant-applying, mandrel-pushing, mandrel-pulling and mandrel-turning steps thus far described are repeated until a drawn tubular product havng desired shape and size is manufactured. Thus, the working conditions which might otherwise become so different as to cause the irregularities in the thickness of the final product can be made uniform in the circumferential direction so that the longitudinal and circumferential irregularities can be automatically eliminated.

In the description thus far made, the turning step of the mandrel, i.e., the drawn blank at an interval between any two consecutive drawing steps is conducted at each retracted position once the drawn blank has been pulled away from the die. Nevertheless, the mandrel turning step may also be conducted during the mandrel pulling step while the mandrel is being pulled. If this latter step is adopted, the production yield can be enhanced because the time period required for the drawing works as a whole can be accordingly shortened.

Here, it is considerably difficult to locate or determine what circumferential portion the irregularities in the thickness of the blank fitted on the mandrel M are caused at. Therefore, we have noted that a drawn blank $P_0$ having an irregular thickness is locally elongated more by l at a thinner longitudinal portion $P_{01}$ than a thicker longitudinal portion $P_{02}$, and have concluded that an ideal method for determining the angle of turns of the mandrel can be obtained, if a thickness reference line R extending at a right angle from the longest position at the innermost edge E of the thinner but longer portion $P_{01}$ to the axis of the blank $P_0$ is located after the pulling step, and if the angle of turns of the mandrel is determined with reference to that thickness reference line R. Once this reference line R is determined, moreover, the mandrel may be turned prior to the subsequent drawing step such that the reference line R is turned 180 degrees on the axis of the mandrel. For practical purposes, nevertheless, whatever direction the thickness reference line R might be oriented in, it is sufficient to turn the mandrel 180 degrees independently of that direction. In order to eliminate the irregularities in the thickness of the drawn blank with high accuracy, on the other hand, a practical method can be provided by determining the angle of turns of the mandrel such that the local elongation l approaches zero as the drawing steps are repeated.

Figure 6:
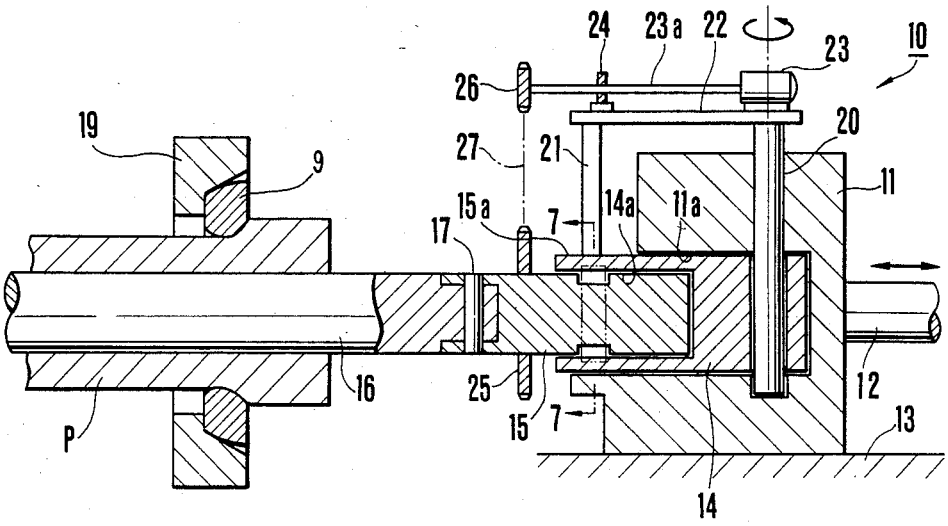
FIG. 6 is a partially sectional side elevation showing an essential portion of the drawn tubing manufacturing press of horizontal type according to the present invention.

Turning now to FIGS. 6 and 7, there is shown an essential portion of a press of horizontal type for manufacturing drawn tubing according to the so-called "push bench process, which is the most proper for practising the aforementioned process of the present invention. The horizontal press generally indicated at 10 includes a cross head 11 which is secured to the leading end of the ram 12 of a (not shown) hydraulic cylinder. The cross head 11 is actuated by the hydraulic cylinder through the ram 12 so that it can horizontally move back and forth while sliding on a bed 13. Indicated at reference numeral 14 is a circular mandrel holder which is fitted in a recess 11*a* formed in the front portion of the cross head 11 such that the mandrel holder 14 can slide in a horizontal direction within said recess 11*a*. The mandrel holder 14 is formed at its front portion with a circular recess 14*a*, in which a mandrel end member 15 is partially fitted such that it can turn on its axis. Indicated at numeral 16 is a mandrel which is removably connected to the mandrel end member 15 by means of a cotter pin 17 extending through their fitted portions. Thus, in case the tubular product or the drawn blank is to have its size changed, the cotter pin 17 is pulled out, and another mandrel 16 is connected to the mandrel end member 15 by inserting the cotter pin 17.

On the other hand, the mandrel end member 15 has its central portion formed in its outer wall with an annular groove 15*a*, in which a pair of cotter pins 18 are fitted such that they vertically extend through the mandrel holder 14 thereby to prevent the mandrel end member 15 from moving longitudinally thereof relative to the mandrel holder 14 while allowing the former to turn relative to the latter. Thus, the annular groove 15*a* and the paired cotter pins 18 constitute together thrust receiving means for receiving the pulling thrust of the not-shown hydraulic cylinder through the ram 12 while ensuring the turns of the mandrel 16 through the mandrel end member 15.

Indicated at numeral 9 is a die which is to receive a bottomed blank P or a formed blank having a thicknwalled cup shape together with the mandrel 16 to draw the blank P into desired shape and size when the blank P is pushed out through the mandrel 16, the mandrel end member 15, the mandrel holder 14, the cross head 11 and the ram 12 by the actuation of the hydraulic cylinder.

As customary, a die holder 19 of cylindrical shape is disposed ahead of the mandrel 16 so that it may hold the die 9.

Through the mandrel holder 14, on the other hand, there vertically extends a swivel pin 20, which is journaled in the cross head 11 thereby to provide a central axis, on which the mandrel 16 is to be swiveled when the blank P is fitted on the mandrel 16. Moreover, a supporting post 21 is erected upright on the mandrel holder 14. A table 22 is placed on both the aforementioned vertical pin 20 and supporting post 21. On the table 22, there are mounted a prime mover or an electric motor 23 for generating a turning force when energized, and a bearing 24 for rotatably supporting the output shaft 23*a* of the motor 23. This turning force is transmitted to the mandrel end member 15 through a power transmission which is connected to the output shaft 23*a* of the motor 23. This power transmission is constructed of a driven sprocket 25 which is mounted on the outer circumference of the mandrel end member 15, a drive sprocket 26 which is secured to the leading end of the output shaft 23*a*, and a chain 27 which is in meshing engagement with both the driven and drive sprockets 25 and 26 for transmitting that turning force of the motor 23 inbetween. Thus, the motor 23, the driven sprocket 25, the drive sprocket 26 and the chain 27 constitute together the turning means for turning the mandrel 16 a predetermined angle on the axis thereof through the mandrel end member 15 relative to the mandrel holder 14 and the cross head 11 thereby to turn the blank P the same angle.

In the horizontal press 10 thus constructed according to the present invention, in case the mandrel 16 is horizontally swiveled before the blank P is to be fitted on the mandrel 16, the above-specified mandrel turning means is also swiveled on the vertical pin 20. Moreover, when it is intended to turn the mandrel 16 on the axis thereof between any two consecutive drawing steps, the mandrel turning motor 23 is started to turn the mandrel base member 15 and accordingly the mandrel 16 through the chain transmission mechanism. In this meanwhile, the mandrel end member 15 can be freely turned on its axis within the recess 14*a* of the mandrel holder 14 because the aforementioned cotter pins 18 do not extend through the mandrel base member 15 but merely engage with the annular groove 15*a* of the same.

Figure 8:
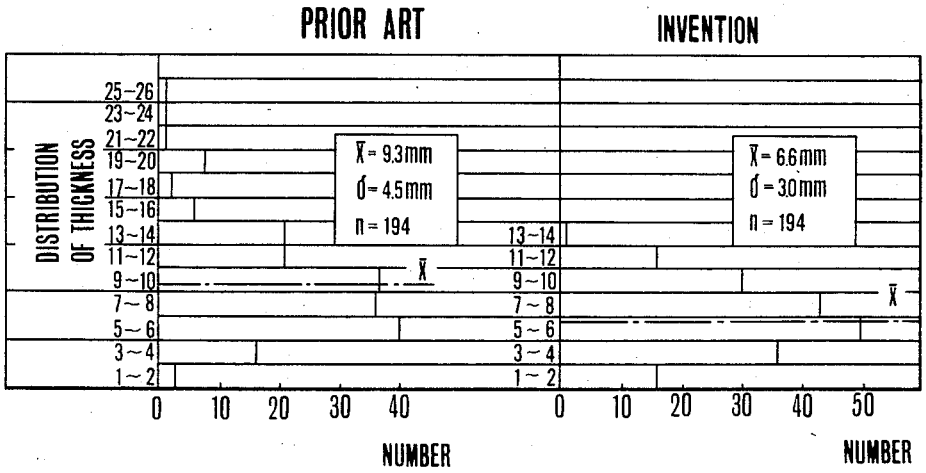
FIG. 8 is a histogram in which distribution of the irregular thickness of the drawn tubular product is compared between the prior art and the present invention.

Thus, it is possible without fail to eliminate the irregularities in the thickness of the drawn tubular product if the mandrel is turned on its axis by the turning means either during an interval between any two consecutive drawing steps or a desired number of times when a local elongation is found out, as has been described hereinbefore. Turning now to FIG. 8, there is presented a histogram in which distribution of the irregular thickness is compared for a sample number $n=194$ between the case in which the mandrel is not turned according to the prior art and the case in which the mandrel is turned according to the present invention. In FIG. 8, letter $\overline{X}$ designates a mean value, and letter $\sigma$ designates a standard deviation. In view of FIG. 8, it is apparent that the irregularities in the thickness of the tubular product can be considerably reduced, although not to zero according to the present invention. This reduction in the irregular thickness leads to advantage that, at the internally and externally cutting steps after the drawn blank has been produced, it is possible not only to reduce the cutting allowance thereby to improve the yield but also to shorten the cutting time and to reduce the wear of the cutting tool used.

Here, the foregoing third cause for the curvature of the mandrel to invite the irregular thickness has in fact the following relationship with the turns of the mandrel although it seems to have no direct relationship. Specifically, a certain mandrel may be influenced by the characteristics of the press used to have a tendency that it is liable to be bent in a certain direction. Nevertheless, if the drawing step is conducted while turning that particular mandrel, the bending tendency is corrected so that the irregular thickness can be prevented at last.

As has been described hereinbefore, according to the present invention, it is possible to produce a drawn tubular product having minimum thickness irregularity while markedly improving the yield.

What is claimed is:

1. A process of manufacturing seamless tubing by using a press having a mandrel and a die, comprising: the steps of:

preparing a formed blank having a thick-walled cup shape;

fitting said formed blank on the mandrel of said press with the bottom of the former abutting against the leading end of the latter;

applying a lubricant to a portion of the surface of said blank;

pushing out said mandrel by the action of said press to draw said blank through the die of said press;

pulling in the drawn blank together with said mandrel out of said die by the action of said press; and repeating the applying, pushing and pulling steps in the recited order until a drawn tubular product having desired shape and size is manufactured, wherein the improvement comprises the step of turning said drawn blank a predetermined angle on the axis thereof with respect to said mandrel during each of said repeating steps, whereby said lubricant can be applied to another portion of the surface of said drawn blank at a second or subsequent applying step so that longitudinal and circumferential irregularities, if any, in the thickness of said tubular product can be eliminated by said turning step after the final repeating step.

2. A process according to claim 1, further comprising the step of determining a thickness reference line, so that the thickness reference line is perpendicular to the axial direction of the drawn blank and to a line extending from the most elongated peripheral position of the drawn blank to the axis of said blank, after the first pulling step.

3. A process according to claim 2, wherein said turning step is conducted with reference to said thickness reference line.

4. A process according to claim 3, wherein said turning step is conducted such that said reference line is turned said predetermined angle on the axis of said extruded blank.

5. A process according to claim 4, wherein said predetermined angle is 180 degrees so that said drawn blank is turned by 180 degrees in the next pulling step.

6. A process according to claim 1, wherein said turning step is conducted when said drawn blank is in its retracted position after it has been pulled in.

7. A process according to claim 1, wherein said turning step is conducted during said pulling step while said drawn blank is being pulled in.

8. A process according to claim 1, wherein said press is of horizontal type so that said lubricant is scattered during each applying step onto the upper surface of said blank.

9. A tubing manufacturing press of horizontal push bench type, comprising:

a hydraulic cylinder for pushing out and pulling in a ram;

a cross head secured to the leading end of said ram and adapted to be actuated by said hydraulic cylinder through said ram for moving back and forth;

a mandrel holder fitted in said cross head;

a mandrel end member fitted in said mandrel for turning on the axis thereof;

a mandrel removably connected to said mandrel end member;

a means of applying lubricant to said tubing; and a die for receiving a blank together with said mandrel to draw said blank into desired shape and size when said blank is pushed out through said mandrel, sand mandrel end member, said mandrel holder, said cross head and said ram by the actuation of said hydraulic cylinder, wherein the improvement comprises turning means for turning said mandrel a predetermined angle on the axis thereof through said mandrel end member relative to said mandrel holder and said cross head thereby to turn said drawn blank said predetermined angle.

10. A horizontal press according to claim 9, wherein said turning means includes: a prime mover for generating a turning force when energized; and a power transmission connected to the output shaft of said prime mover for transmitting the turning force of said prime mover to said mandrel end member.

11. A horizontal press according to claim 10, wherein said power transmission has a drive sprocket secured to said output shaft, a driven sprocket mounted on the circumference of said mandrel end member, and a chain meshing with both said drive and driven sprockets for transmitting said turning force inbetween.

12. A horizontal press according to claim 9, further comprising pulling thrust receiving means interposed between said mandrel holder and said mandrel end member for receiving the pulling thrust of said hydraulic cylinder while ensuring the turns of said mandrel through said mandrel end member.

13. A horizontal press according to claim 12, wherein said thrust receiving means includes: an annular groove formed in the outer wall of said mandrel end member; and a pair of cotter pins extending through said mandrel holder and fitted in said annular groove for preventing said mandrel end member from moving longitudinally thereof relative to said mandrel holder while allowing the former to turn relative to the latter.

14. A horizontal press according to claim 9, further comprising swivel means for allowing said turning means to be horizontally swiveled together with said mandrel through said mandrel end member and said mandrel holder.

15. A horizontal press according to claim 14, wherein said swivel means includes: a vertical pin journaled in said cross head for providing a central axis, on which said mandrel is to be swiveled; a supporting post erected upright on said mandrel holder; and a table placed on said vertical pin and said supporting post and mounting thereon said prime mover.

* * * * *